United States Patent [19]

Thom, Jr.

[11] Patent Number: 5,072,887

[45] Date of Patent: Dec. 17, 1991

[54] ROLL MILL

[75] Inventor: Kelsey C. Thom, Jr., Waterloo, Iowa

[73] Assignee: California Pellet Mill Company, San Francisco, Calif.

[21] Appl. No.: 467,701

[22] Filed: Jan. 19, 1990

[51] Int. Cl.[5] ..... B02C 4/32

[52] U.S. Cl. ..... 241/37; 241/232; 241/234

[58] Field of Search ..... 241/230, 231, 232, 233, 241/234, 39, 101.2; 72/240, 243, 199; 100/168, 169, 155 R

[56] References Cited

U.S. PATENT DOCUMENTS

| | | | |
|---|---|---|---|
| 3,509,815 | 5/1970 | Lloyd | 241/37 X |
| 3,970,256 | 7/1976 | Roegger et al. | 241/234 X |
| 4,339,083 | 7/1982 | Linzberger et al. | 241/37 |
| 4,635,861 | 1/1987 | Resch | 241/234 X |

FOREIGN PATENT DOCUMENTS

| | | | |
|---|---|---|---|
| 3723605 | 1/1989 | Fed. Rep. of Germany | 241/234 |
| 279328 | 5/1970 | U.S.S.R. | 241/234 |

*Primary Examiner*—Mark Rosenbaum
*Attorney, Agent, or Firm*—Walter C. Vliet

[57] ABSTRACT

Disclosed is a device for automatically adjusting the roll gap between the rolls of a roll mill including simultaneously operated screw jacks which adjust the gap and a shaft mounted geared box drive to accomplish the drive of the secondary roll from the primary roll further including a drive tensioning device which permits automatic adjustment of the roll gap while maintaining tension between the drive belts utilized for driving the shaft mounted gear box. The combination permits the automatic selection and adjustment of roll gap without further adjustment to accommodate the drive to the different roll gap settings.

9 Claims, 4 Drawing Sheets

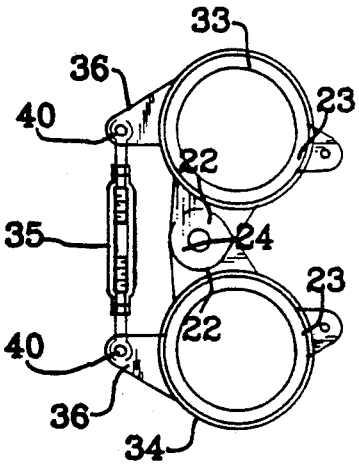
FIG. 9
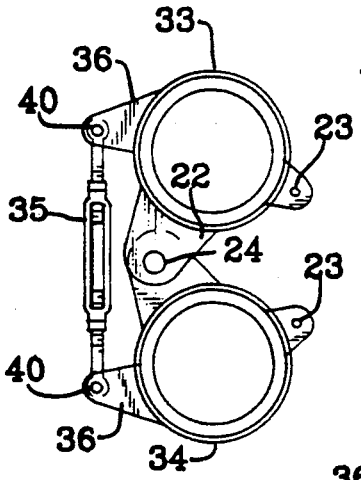
FIG. 10
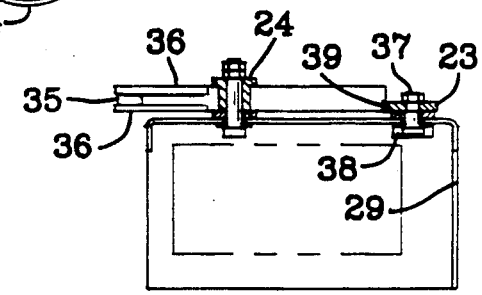
FIG. 11
FIG. 6
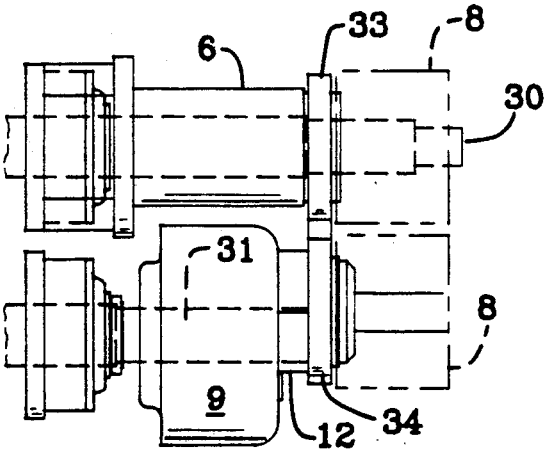
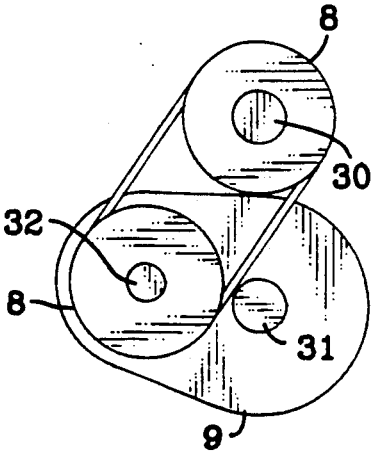
FIG. 7
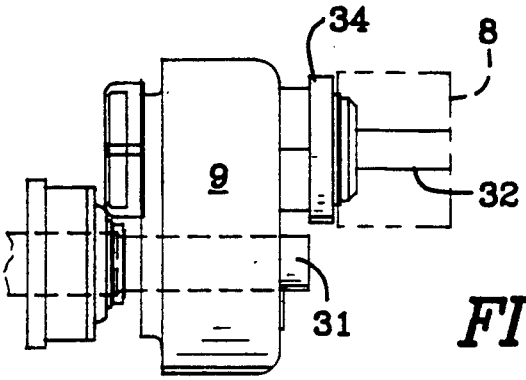
FIG. 8

ROLL MILL

BACKGROUND OF THE INVENTION

This invention relates generally to roll mills for particle reduction including grinding and cracking of, for example, feed products. Two of the common problems associated with roll mills are the adjustment of the rolls relative to one another to effect the grinding or crushing of the particulate matter between the rolls and the drive means required for driving the two rolls simultaneously from a single power source at different speeds required for efficient particle reduction. In the past, this has been accomplished by either independent drives or cumbersome devices requiring additional adjustments with varying roll gaps.

SUMMARY OF THE INVENTION

In one aspect of the present invention this is accomplished by providing an adjustable roll mill including direct coupled means for simultaneously adjusting the bearing spacing on each end of the rolls and providing a shaft mounted gear box having an independent belt tensioning device which maintains belt tension automatically at each roll gap setting. The combination provided herein permits higher horsepower to be transmitted to the operating rolls and for automatic function of roll gap and further permits the accommodation of tramp material between the rolls without damaging the operating mechanism.

These and other objects of the invention are obtained in an adjustable roll mill assembly comprising: a pair of opposed rolls in longitudinal alignment including a primary roll and a dependent roll mounted in bearings permitting the adjustment of distance between the centerlines of the rolls; means for adjusting the distance between the rolls; a primary drive means for said primary roll; a shaft mounted dependent drive means interposed between the rolls to accomplish drive of the dependent roll; and means for accommodating the gap change between the rolls automatically in the dependent roll drive means.

The foregoing and other aspects will become apparent from the following detailed description of the invention when considered in conjunction with the accompanying drawing figures.

BRIEF DESCRIPTION OF THE DRAWINGS

In the Drawings:

FIG. 6 is a plan view of the shaft mounted gear box according to the present invention.

FIG. 7 is an end view of the shaft mounted gear box.

FIG. 8 is a side elevation of the shaft mounted gear box.

FIG. 9 is an end view of the belt tensioning device according to the present invention in its maximum takeup position.

FIG. 10 is an end view of the belt tensioning device in its minimum takeup position.

FIG. 11 is a front elevation of the belt tensioning device showing the belt guard mounted in place.

DETAILED DESCRIPTION OF THE PREFERRED EMBODIMENT

Figure 1:
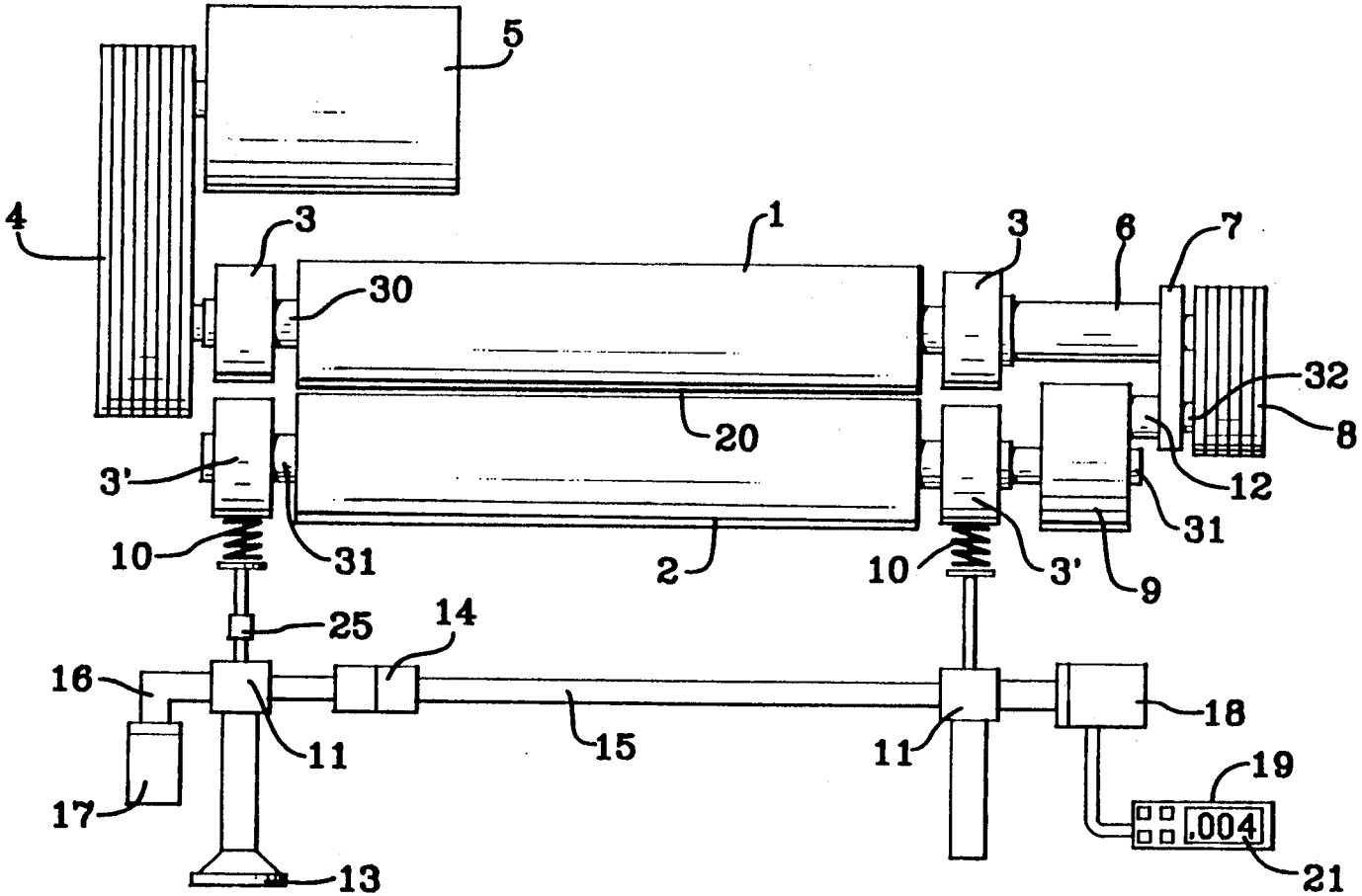
FIG. 1 is a plan view of the roll mill drive and adjustment means of the present invention.

Referring to FIG. 1 an adjustable roll assembly according to the present invention is shown having a pair of adjacent rolls 1 and 2 having an adjustable gap 20 therebetween. The primary driven roll 1 is shown mounted in a pair of bearings 3 for rotation on a shaft 30. The driven roll 2 is likewise mounted for rotation in bearings 3' on a shaft 31. It should be appreciated by one skilled in the art that particles passing in the gap 20 between the rolls will be ground, cracked, or otherwise comminuted and reduced in particle size.

Main drive motor 5 rotates the driven roll 1 through a main drive V-belt drive 4. Drive of the driven roll 2 is accomplished by power takeoff from roll 1 through an extension of its shaft 30 to a V-belt drive 8 which in turn drives the driven gear box shaft 32 and through a gear reduction in the shaft mounted gear box 9 drives the driven roll shaft 31 and hence the driven roll 2. Details of the power takeoff drive will be more fully explained later.

The driven roll is urged towards the drive roll by a pair of precision machine screw jacks 11 which jack against the bearings 3' through a set of strong disc springs 10. Positioning of the jack screws is accomplished by motor 17 driving the jack nut through an angle drive 16 and a coupling shaft 15 having a rigid coupling 14 which permits the simultaneous adjustment of the jack nuts and hence the extension of the jacks at both ends of the roll.

An optical encoder 18 and controller 19 with digital readout 21 permits accurate setting of the gap 20 by automatically adjusting the extension of the machine screw jacks. Parallel adjustment between the two jacks may be accomplished by a manually adjusted rigid coupling 14 and the minimum roll gap adjustment can be made manually by a hand wheel 13 or automatic remote control using the optical encode and controller.

It should be appreciated by one skilled in the art that the adjustment of gap 20 may now be accomplished by automatic means. To further permit this adjustment, without further adjustment of the drive means between the rolls, a unique power takeoff or interroll drive is provided. Referring to FIGS. 6 through 8, nonrotating tension base 6 is bolted to the bearing block of the drive roll 1. Mounted for rotation on the tension base 6 is a driving roll tension ring 33. A similar roll tension ring 34 is mounted for rotation on the gear box extension 12 on gear box 9. Gear box 9 has its output on a gear which drives driven roll 2 through shaft 31. Shaft mounted gear box 9 is otherwise free to rotate about shaft 31.

The V-belt drive 8 transmits power between drive roll shaft 30 and gear box shaft 32. The gear box in turn has its power output as previously mentioned on shaft 31. Referring to FIG. 7 it should be apparent that for the roll gap 20 to change, the distance between shaft 30 and shaft 31 will similarly change. Shaft mounted gear box 9 is restrained from rotation about shaft 31, about which it is free to rotate by the belt tensioning means of this invention which may be more readily understood by referring to FIGS. 9 through 11.

The belt tensioning device is comprised primarily of two tension rings: a driving roll tension ring 33 and a gear box tension ring 34. Each of these tension rings are free to rotate about the respective devices on which they are mounted, i.e., the tension base 6 which is concentric about the drive roll shaft 30 and the gear box extension 12 which is concentric about the driven gear box shaft 32. A lug 22 extends from each of the tension rings 33, 34, and are joined together by a pivot 24.

Also extending from the tension rings are a pair of fingers 36 which are operably joined together by means of a turnbuckle 35 attached to each of the fingers 36 by a pin 40. It should be appreciated by referring to FIGS. 9 and 10 that as the turnbuckle is extended the rings are rotated about the tension base and the gear box extension from a position wherein the lugs 22 are positioned near the centerline providing maximum belt tension to a position shown in FIG. 10 when the turnbuckle is extended wherein minimum belt tension is provided.

Also extending from the tension rings are a pair of guard attachment lugs 23. As shown in FIG. 11 a guard 29 may be mounted to the tensioning device by means of a guard mounted bolt 37 and a spacer 39. The bolts cooperate with the guards 29 in a slot 38 which accommodates the required movement between the centerlines of the bolt attachment points on the guard attachment lugs 23.

It should now be appreciated by one skilled in the art that tension in the V-belt drive between the drive roll shaft 30 and the driven gear box shaft 32 may be readily accomplished and maintained regardless of the orientation of the tensioning device about the tension base 6 or the gear box extension 12. Since the tensioning device is free to rotate, and the gear box is also free to rotate, it may be appreciated that although the distance between the drive roll shaft and the driven gear box shaft may remain constant, to accomplish belt tension, the dog leg formed between the tensioning device and the offset of the gear box housing provides for the required variation in the gap 20 between the rolls simply by rotation of the dog leg without further adjustment.

Figure 2:
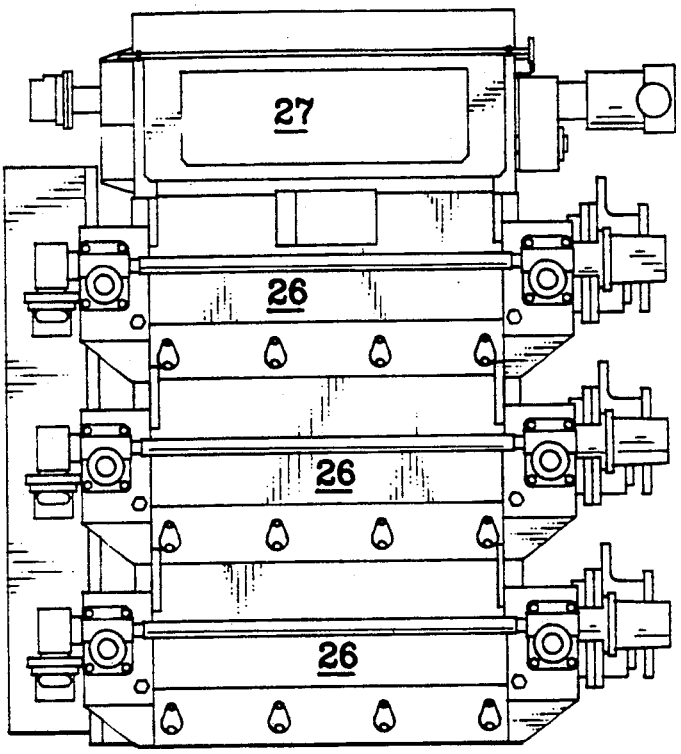
FIG. 2 is a front view of a stack of assembled roller pairs.
Figure 3:
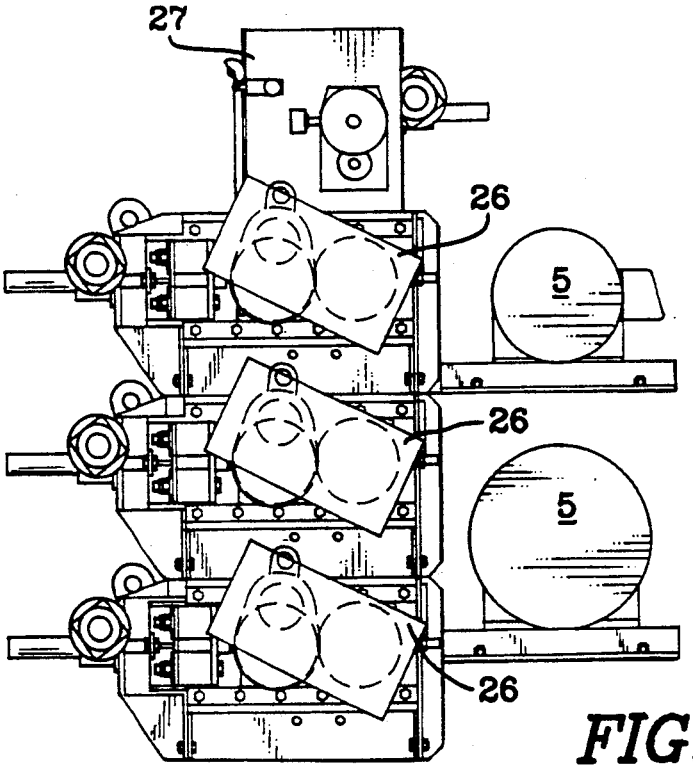
FIG. 3 is a side view of a stack of assembled roller pairs.

FIGS. 2 and 3 show a convenient arrangement of three roll assemblies 26 according to the present invention stacked in a vertical arrangement being fed by a roll feeder 27. The convenience of the roll adjusting mechanism provided according to the present invention and the orientation of the roll adjusting device may now be appreciated in relationship to the main drive motors.

Figure 4:
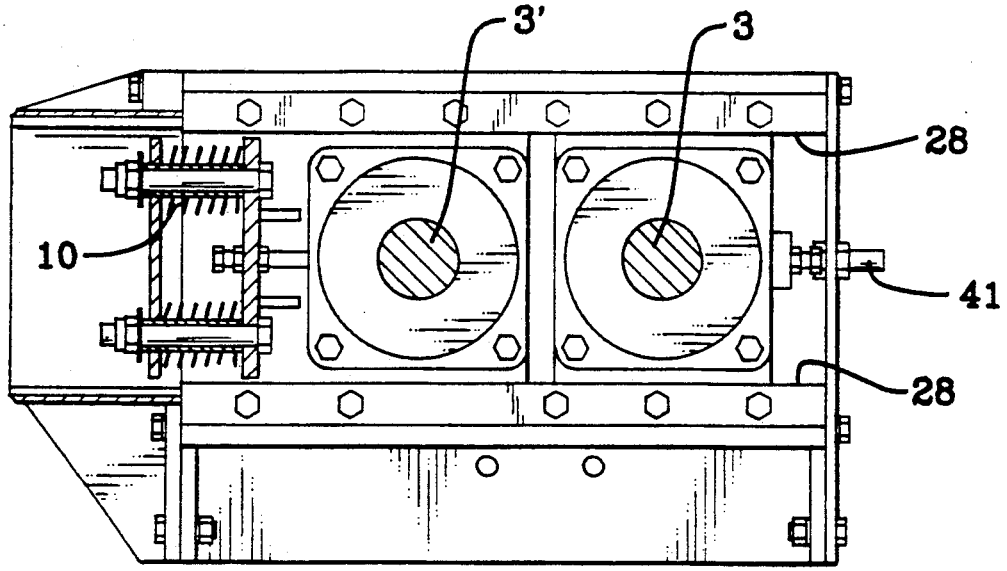
FIG. 4 is a partially sectioned end view of the bearings for the rolls.
Figure 5:
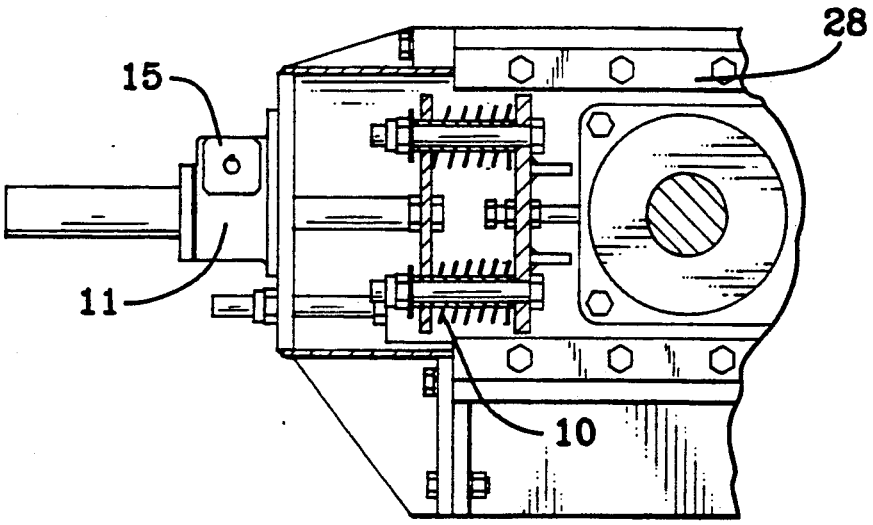
FIG. 5 is a partially sectioned end view showing the roll adjustment device in detail.

Referring to FIG. 4 the bearing mounting assembly is shown mounting the bearings 3, 3' in a U shaped guide 2 which permits the movement of the mounting bearings towards and away from each other. Control of this movement is accomplished by lock screw 41 in the case of the drive roll bearing 3 and by means of the machine screw jacks 11, 15' providing force against the driven roll bearing 3' through disc spring assembly 10. The disc spring assembly is provided to allow for the rolls to move apart to prevent damage in case of overload created, for example, by tramp material passing between the rolls. The guides 28 are formed in a U channel which permits the bearing blocks 3 and 3' to move in a linear direction apart and conversely together.

In operation, it should be appreciated that the gap 20 may be automatically adjusted by sensing the gap by means of the optical encoder and adjusting the gap by setting the required gap in the controller 19 which in turn would control the motor which drives the machine screw jacks as previously described. The new roll gap is accomplished without further adjustment and operation may be immediately resumed or continued during operation.

While this invention has been illustrated and described in accordance with a preferred embodiment, it is recognized that variations and changes may be made without departing from the invention as set forth in the claims.

I claim:

1. An adjustable roll mill assembly comprising:

a pair of opposed rolls in longitudinal alignment including a primary roll and a dependent roll mounted in bearings permitting the adjustment of distance between the centerlines of said rolls;

means for adjusting the distance between said rolls;

a primary drive means for said primary roll;

a drive means interposed between said rolls to accomplish drive of said dependent roll including:

a gear box mounted for rotation on an end shaft of one of said opposed rolls having a first drive element in axial alignment with the centerline of one of said rolls and a second gear box drive element in fixed parallel offset axial alignment with said first drive element;

said second drive element being driven by said first drive element at a selected drive ratio;

drive means interposed between said second drive element and the other of said opposed rolls for transmitting drive between said second drive element and the other of said opposed rolls; and said drive means including selectively adjustable means for establishing the distance between the centerline of said second drive element and said other of said opposed rolls and to prevent rotation of said gear box about said one drive roll.

2. An adjustable roll mill assembly according to claim 1 wherein said roll bearings are mounted in linear slide means.

3. An adjustable roll mill assembly according to claim 1 wherein said means for adjusting the distance between said rolls comprises:

a pair of machine screw jacks which are simultaneously operated.

4. An adjustable roll mill assembly according to claim 1 wherein said drive means further comprises:

a tension adjustment and positioning means interconnecting said gear box and a tension base mounted on a bearing associated with said other opposed roll.

5. An adjustable roll mill assembly according to claim 4 wherein said drive means comprises:

a V-belt drive; and said tensioning means provides tension and adjustable spacing between sheaves of said V-belt drive.

6. An adjustable roll mill assembly according to claim 1 wherein said selectively adjustable means further comprises:

a spring tensioning device having tension rings mounted for rotation on one of said opposed rolls and said second drive element, said tension rings being connected by pivot means and further being provided with means for effecting rotation about said pivot to accomplish a change of center between said roll and said second drive element.

7. An adjustable roll mill assembly according to claim 6 wherein said means for effecting rotation about said pivot point further comprises:

a turnbuckle; and said ring means further comprises:

mounting means for a guard means encircling said drive means.

8. An adjustable roll mill assembly according to claim 5 wherein said means for adjusting said machine screws further comprises:

a simultaneously rotated pair of jack nuts which operate the jack screws in extension and retraction.

9. An adjustable roll mill assembly comprising:

a pair of opposed rolls mounted in roll bearings in parallel alignment having means for permitting variation of the gap between the rolls;

means for simultaneously adjusting the position of the rolls at each end to provide a constant gap between the rolls;

means for sensing the roll gap;

means for accomplishing the adjustment of the roll gap automatically; and means for driving one roll in relationship to the other roll including automatic means for compensating the drive means for the variation in distance between said rolls to permit automatic adjustment of the rolls without further adjustment of the drive means further comprising:

a gear box rotatably mounted on one of said opposed rolls having rotating power input from said one of said opposed rolls and having a fixed position offset parallel output; and power transmission means of fixedly adjustable center distance between said offset parallel output and the other of said opposed rolls.

* * * * *